US007601108B2

(12) United States Patent
Andrews

(10) Patent No.: US 7,601,108 B2
(45) **Date of Patent: *Oct. 13, 2009**

(54) ANTERIOR SHOULDER STRETCHING DEVICE

(76) Inventor: Stuart John Andrews, 8 Dry Street Curtin ACT 2605, Kingston (AU) 2605

( * ) Notice: Subject to any disclaimer, the term of this patent is extended or adjusted under 35 U.S.C. 154(b) by 0 days.

This patent is subject to a terminal disclaimer.

(21) Appl. No.: 12/165,505

(22) Filed: Jun. 30, 2008

(65) Prior Publication Data

US 2008/0261783 A1 Oct. 23, 2008

Related U.S. Application Data

(63) Continuation of application No. 10/561,405, filed as application No. PCT/US2004/000724 on May 31, 2004, now Pat. No. 7,393,310.

(30) Foreign Application Priority Data

Jun. 19, 2003 (AU) ..... 20033903082

(51) Int. Cl.
*A63B 21/00* (2006.01)

(52) U.S. Cl. ..... 482/131; 482/907

(58) Field of Classification Search ..... 482/907, 482/111–113, 130, 131
See application file for complete search history.

(56) References Cited

U.S. PATENT DOCUMENTS

| | | | | |
|---|---|---|---|---|
| 5,277,681 | A * | 1/1994 | Holt | 482/112 |
| 5,374,230 | A * | 12/1994 | Bonnaime | 482/112 |
| 5,507,711 | A * | 4/1996 | Richardson | 482/112 |
| 5,904,641 | A * | 5/1999 | Huang | 482/131 |
| 6,352,495 | B1 * | 3/2002 | Hsu | 482/92 |
| 6,733,426 | B2 * | 5/2004 | Bussell | 482/112 |
| 7,393,310 | B2 * | 7/2008 | Andrews | 482/131 |

* cited by examiner

*Primary Examiner*—Fenn C Mathew
(74) *Attorney, Agent, or Firm*—Daniel L. Dawes; Marcus C. Dawes

(57) ABSTRACT

An user-actuated anterior shoulder stretching device (10) includes a pair of swing arms (32) which are pivoted rearwardly in response to a leg press motion being applied to a sliding footrest assembly (18).

10 Claims, 4 Drawing Sheets

ANTERIOR SHOULDER STRETCHING DEVICE

FIELD OF THE INVENTION

The invention relates to an anterior shoulder stretching device. As used herein, the term "anterior shoulder" is generically used to refer to the shoulder, chest and arm.

BACKGROUND ART

The anterior shoulder (pectoral muscles, anterior deltoids, biceps, forearms and all connective tissue associated with these muscle groups) often becomes tight and dominant over the posterior shoulder, resulting in rounded shoulders, poor posture, and other complications. This is particularly problematic with subjects who spend substantial amounts of time working at computers. The applicant speculates that this anterior shoulder dominance and associated lack of flexibility in the anterior shoulder may also be associated with emerging nerve-related conditions such as occupational overuse syndrome (OOS), repetitive stress injury (RSI), and carpel tunnel syndrome. Since the anterior muscle groups tend to dominate they need to be addressed first before attempting to correct problems with the often under-used posterior muscle groups.

In addition to the needs of the general population as outlined above, there also exists a need amongst athletes for an anterior shoulder stretching device for the purpose of preventing or rehabilitating shoulder injuries, and for maximising performance. In this regard, anterior shoulder flexibility is required for any sporting activity which requires balanced shoulder muscle groups for either performance or injury prevention, e.g. throwing or swimming.

The anterior shoulder is particularly difficult to stretch without assistance. Accordingly, to date, useful anterior shoulder stretching has required the assistance of a therapist. Typically, the therapist will stand behind the seated or standing subject, will support the centre of the subject's back, and will pull the subject's arms rearwardly to thereby stretch the anterior shoulder. The stretch can be varied by rotating the subjects wrists so that the palms of the subject's hands may point upwardly, forwardly, or downwardly. These variations particularly alter the degree of stretch felt in the biceps, forearms, deltoids and pectoral muscles depending on the orientation of the palms and wrists and forearms.

There are several disadvantages associated with the prior art assisted stretches. Firstly, they require the presence of an assistant. Given that stretching should occur regularly, it is often impossible to have access to an assistant at the desired times. Secondly, there is the tendency of the subject to not relax fully and maximise the stretch, particularly where the shoulder is injured and painful. In this regard, the natural self-preservation instinct is to not fully trust the assistant and to resist the stretch to not allow the full effect of the stretch to be maximised.

SUMMARY OF INVENTION

The present invention provides a user-actuated anterior shoulder stretching device according to the following claims. Preferably, the device is actuated by the legs of the user. However, in the case of wheelchair athletes, for example, the device may be manually actuated and may employ an electric motor or the like to drive the device. Other preferred features of the invention will be apparent from the dependant claims and from the following description of the preferred embodiment.

BRIEF DESCRIPTION OF DRAWINGS

The invention will now be described in a non-limiting manner with respect to a preferred embodiment in which:—

DETAILED DESCRIPTION OF PREFERRED EMBODIMENT

Figure 1:
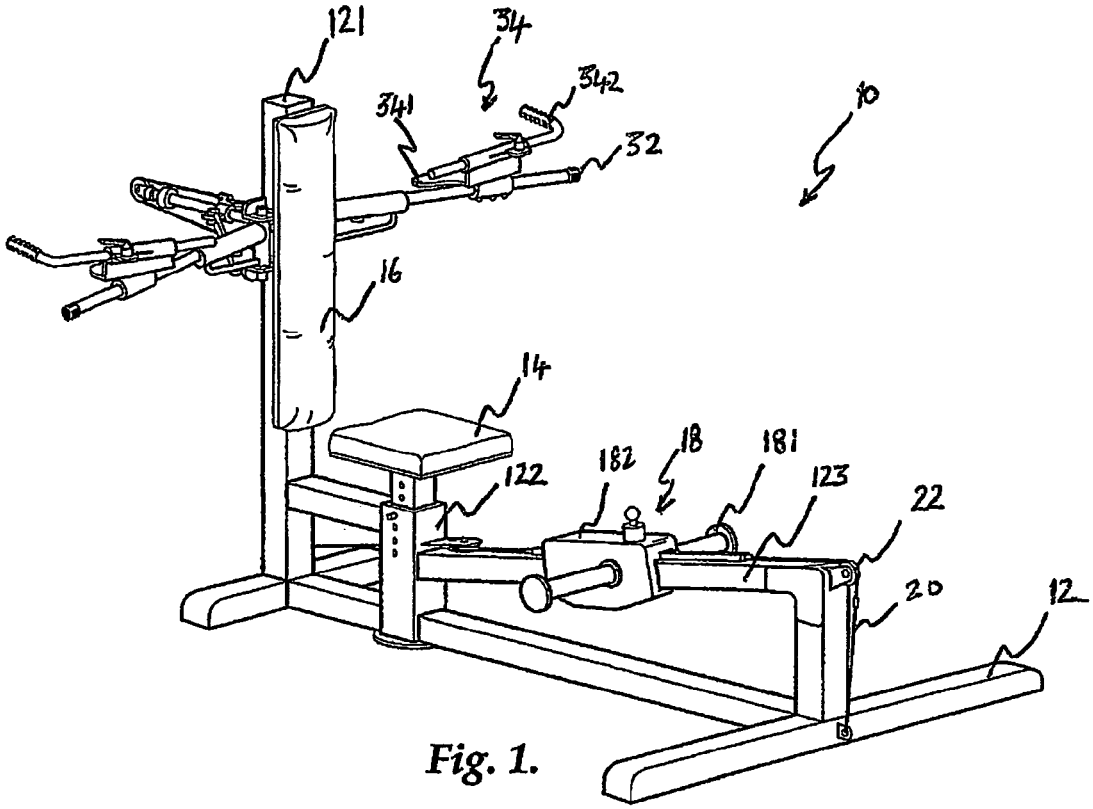
FIG. 1 is front perspective view of a user-actuated anterior shoulder stretching device according to the present invention.

With reference to FIG. 1, there is illustrated an anterior shoulder stretching device 10.

The device includes a frame 12 which is formed of lengths of rectangular hollow section (RHS) steel. The frame 12 includes an upright post 121, a seat receiving tube 122, and an inclined rail 123.

A height adjustable seat 14 is received in the seat receiving tube 122, a backrest 16 is mounted on the front face of the upright post 121, and a sliding footrest assembly 18 is mounted on the inclined rail 123.

Figure 2:
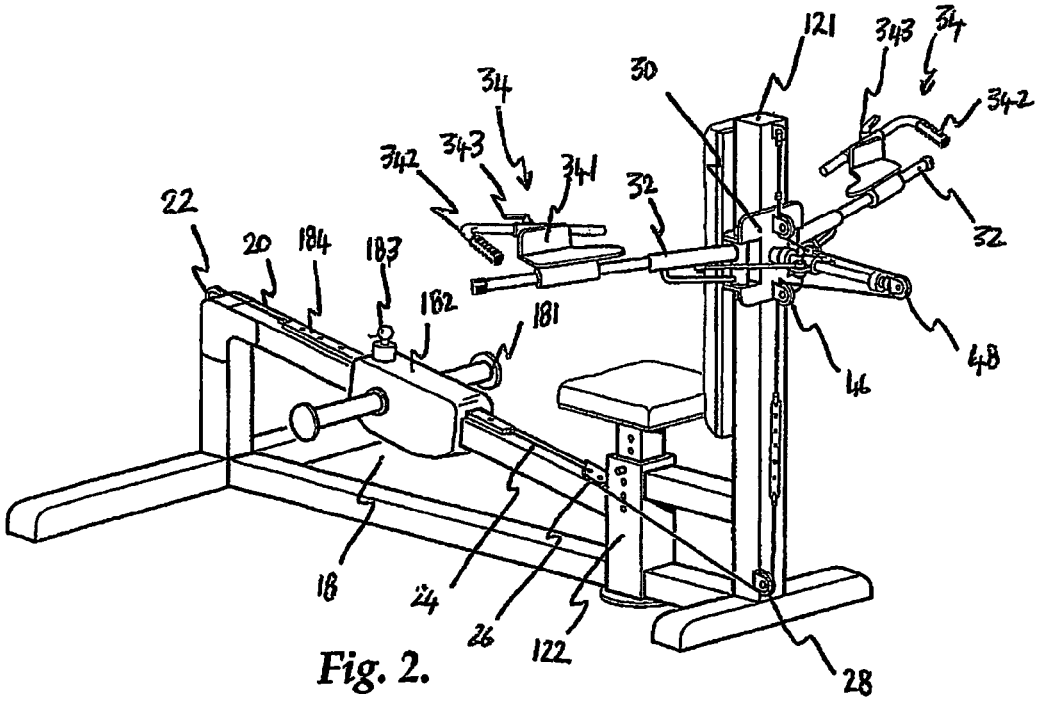
FIG. 2 is a rear perspective view of the device of FIG. 1.
Figure 3:
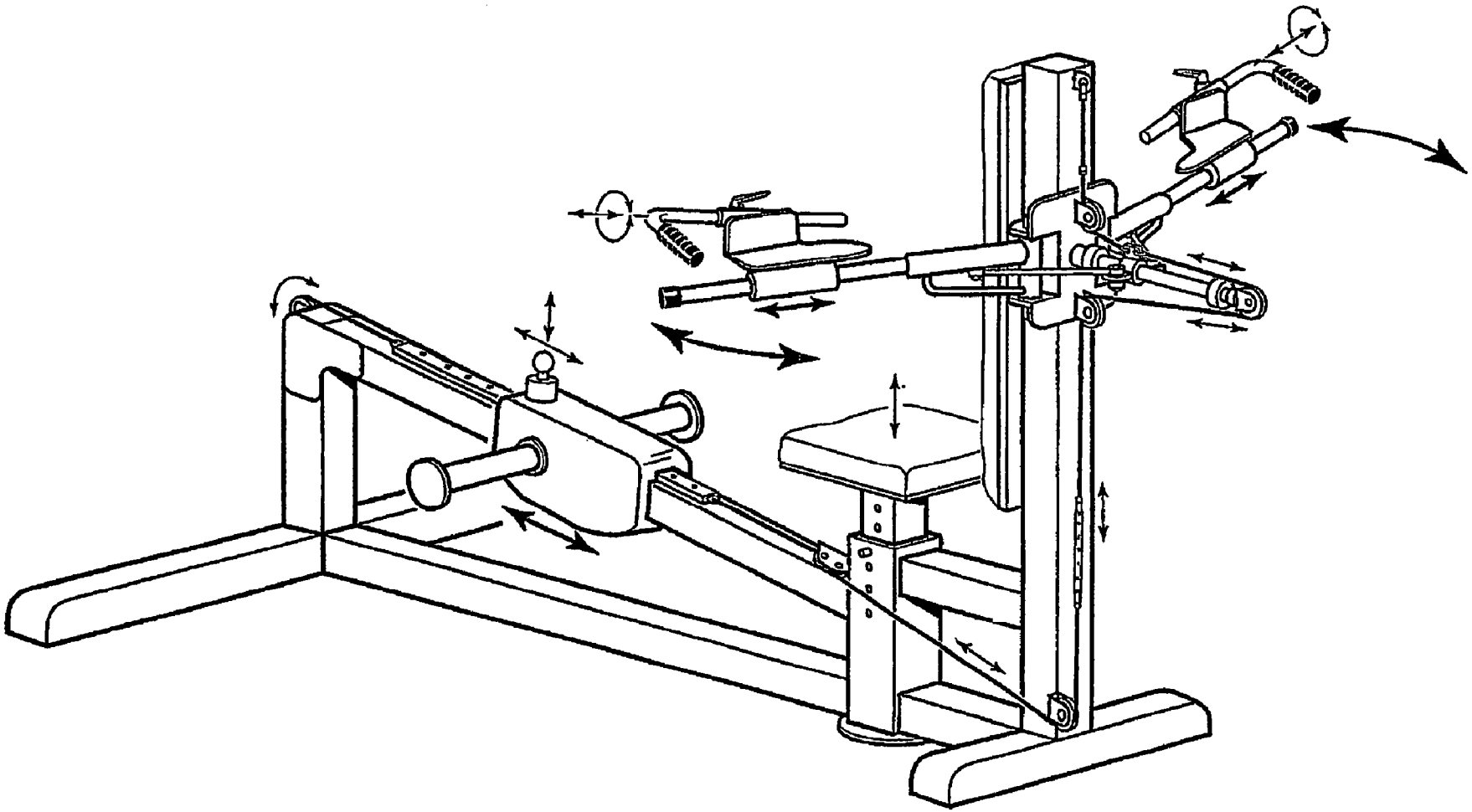
FIG. 3 is an enlarged rear perspective view with indications of moving parts.

With reference to FIG. 2, the sliding footrest assembly 18 includes a pair of footpegs 181 which extend oppositely and laterally from a housing 182 which slides on inclined rail 123. The default position of the housing 182 on the inclined rail 123 can be adjusted with the assistance of pin 183 which engages one of the several apertures formed in the elongate, apertured plate 184 to accommodate users of differing leg lengths.

The forward end of the elongate apertured plate 184 is connected to a resilient cord 20 which extends over pulley 22 and is anchored to frame 12. The rearward end of elongate apertured plate 184 is connected to a non-resilient cable 24 which is diverted laterally around seat receiving tube 122 by pulley 26, and then turned up the rear side of upright post 121 by pulley 28.

A plate 30 is fixed to the rear side of upright post 121. A pair of swing arms 32 are pivotably mounted to the plate 30 and extend laterally and oppositely away from the plate. An arm support assembly 34 is slidably mounted on each swing arm 32. Each arm support assembly 34 includes a forearm/elbow supporting platform 341 which is mounted via a sliding bearing to the swing arm. A hand grip 342 is rotatably mounted to the forearm/elbow supporting platform 341 and can be locked in a desired rotative position by a frictional quick release device 343.

Figure 7:
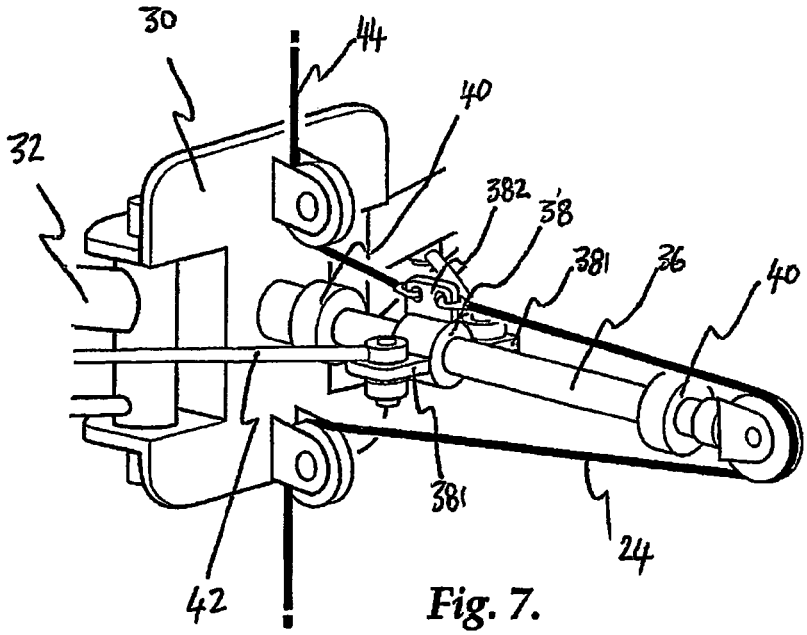
FIG. 7 is a detailed perspective view of the mechanism.

With reference to FIG. 7, a collar mounting post 36 extends rearwardly from the plate 30. A collar 38 is slidably mounted on the collar mounting post 36 for limited sliding movement between stops 40. A pair of horizontal lugs 381 extend laterally from the collar 38. A tie bar 42 is pivotably attached to each horizontal lug. The other end of each tie bar 42 is pivotably attached to a swing arm 32. Accordingly, it will be appreciated that rearward movement of collar 38 results is rearward pivoting of swing arms 32.

A vertical lug 382 extends upwardly from the collar 38 and includes a pair of spaced apertures. The rearward aperture receives cable 24, whilst the forward aperture receives a resilient cord 44.

Returning to FIG. 2, it will be recalled that the cable 24 extended up the rear side of the upright post 121 from pulley 28 to pulley 46 whereat it is turned rearwardly to pulley 48 and then forwardly to vertical lug 382 of collar 38.

In use, after adjusting the seat 14 to the desired height such that the user's shoulder aligns with swing arms 32, the user sits down with their back against the backrest 16. The user adjusts the distance between seat 14 and sliding footrest assembly 18 with the assistance of the pin 183. The user than places their feet on the footpegs 181, and places their arms on the forearm/elbow supporting platforms 341 with their hands engaging handles 342. The angular position of the handles 342 is adjusted as desired with the assistance of the quick release device 343.

Figure 4:
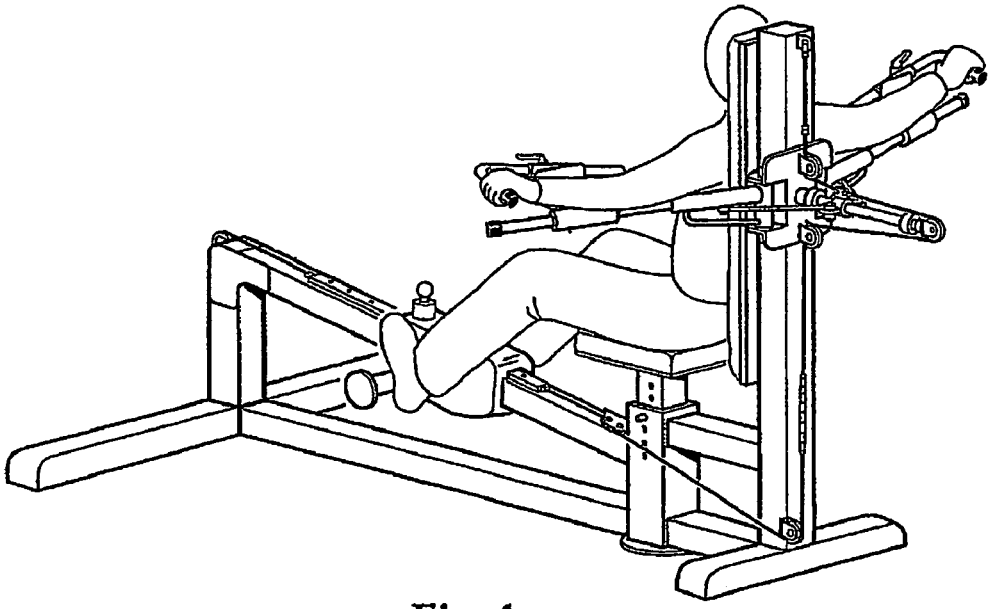
FIGS. 4 and 5 are sequential rear perspective views of the device in operation with the palms facing downwardly.

The user then presses the sliding footrest assembly 18 away from themselves in a conventional leg press motion. As the sliding-footrest assembly 18 moves away from the user, the cable 24 causes collar 38 to slide rearwardly on the collar mounting post 36 thereby stretching resilient cord 44 and articulating swings arms 32 rearwardly from the position shown in FIG. 4 to the position shown in FIG. 5. It will be noted that the arm support assemblies 34 slide inwardly on the swing arms 32 as the swing arms 32 pivot rearwardly.

When the user releases the pressure an the footpegs 181, the swing arms return to the starting position under the influence of resilient cord 44 which acts as a return spring. Alternatively, a coil spring could be mounted on collar mounting post 36 for the same effect. The other resilient cord 20 acts to prevent sliding footrest assembly 18 from sliding down the inclined rail 123 under the influence of gravity thereby ensuring that cable 24 remains under a small amount of tension and thereby maintaining cable 24 in contact with pulleys 26, 28, 46 and 48.

Figure 5:
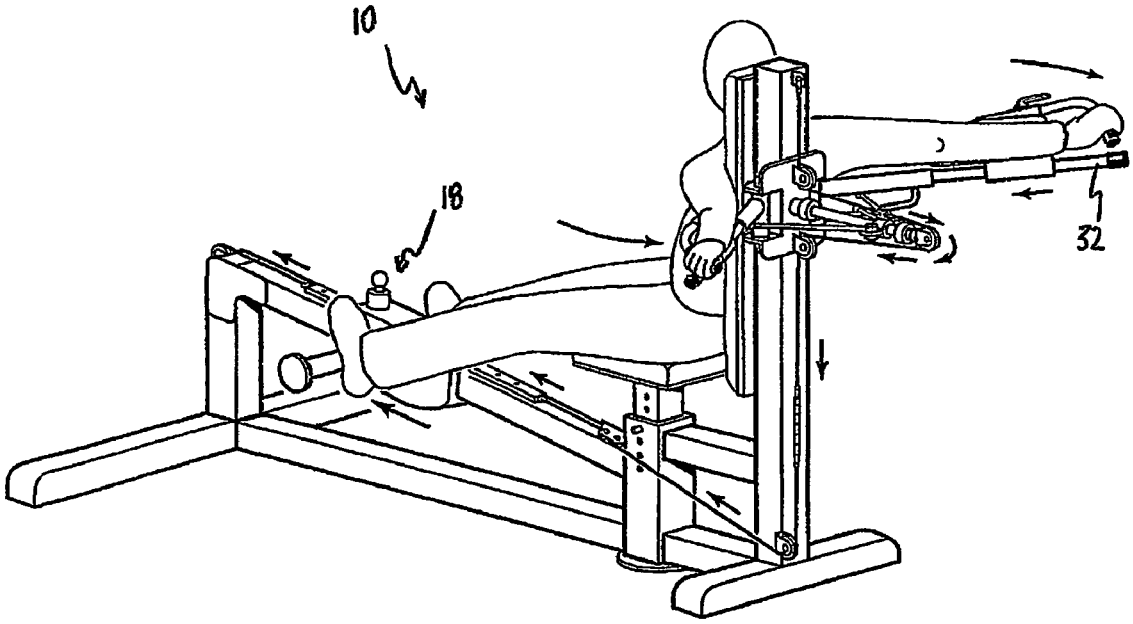
Figure 6:
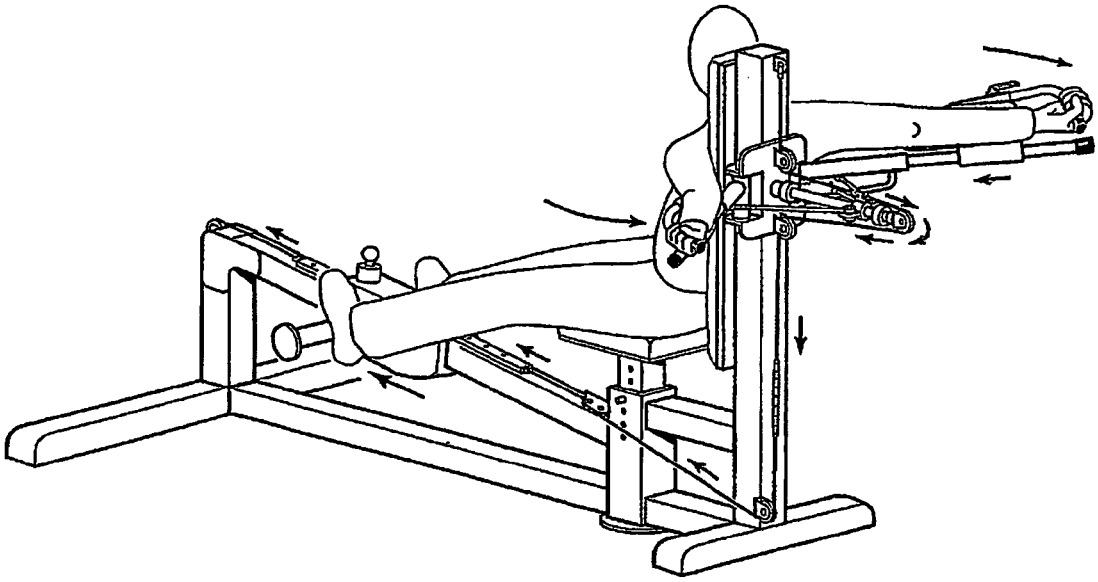
FIG. 6 is equivalent to FIG. 5, except that the hands, wrist and forearms have been rotated rearwardly so that the palms now face upwardly.

With comparative reference to FIGS. 5 and 6 it can be seen that the angular orientation of the handles has been adjusted from the position shown in FIG. 5 which targets the biceps, forearms and anterior deltoids, to the position shown in FIG. 6 which targets the pectorals and anterior deltoids.

Whilst the preferred embodiment of the invention has been described with reference to a leg press actuation, other types of user actuation may be employed. For example, the above-described leg press actuation could be replaced by a manual actuation system. This would be especially useful for wheelchair athletes. In one embodiment, collar mounting post 36 could include an external thread and collar 38 could include a complementary internal thread. The collar mounting post 36 could be rotated about its axis by an electric motor to thereby drive collar 38 rearwardly and forwardly along the length of the collar mounting post 36. The electric motor would be controlled via a switch mounted on or adjacent to handle 342. Alternatively, the linear leg press device could be replaced with a push down lever which is mounted at the base of the seat receiving post 122 and extends upwardly and forwardly. This arrangement would be more space-efficient than the linear press device illustrated.

The invention claimed is:

1. A leg-actuated anterior shoulder stretching device comprising:

a backrest having a support surface for supporting the back of a user;

a pair of swing arms linked to pivot in unison about one or more pivot axes located adjacent to the backrest and in opposite rotational directions between a non-stretching position and a stretching position; and a leg-actuated mechanism for pivoting the swing arms in unison from the non-stretching position to the stretching position, wherein the one or more pivot axes are generally parallel to the support surface and are located rearwardly of the support surface.

2. A leg-actuated anterior stretching device as claimed in claim 1, wherein the swing arms pivot in a plane and wherein the support surface of the backrest extends on both sides of the plane.

3. A leg-actuated anterior shoulder stretching device comprising:

a backrest having a support surface for supporting the back of a user;

a pair of swing arms linked to pivot in unison and in opposite rotational directions between a non-stretching position defining an angle of approximately 180 degrees between the swing arms and a stretching position defining a reflex angle of greater than 180 degrees between the swing arms; and a leg-actuated mechanism for pivoting the swing arms in unison from the non-stretching position to the stretching position.

4. A leg-actuated anterior stretching device as claimed in claim 3, wherein the swing arms are biased to the non-stretching position.

5. A leg-actuated anterior shoulder stretching device comprising:

a backrest having a support surface for supporting the back of a user;

a pair of swing arms linked to pivot in unison in a plane and in opposite rotational directions between a non-stretching position and a stretching position, said swing arms pivoting in a plane which is substantially orthogonal to the support surface of the backrest;

a leg-actuated mechanism for pivoting the swing arms in unison from the non-stretching position to the stretching position, the leg-actuated mechanism being located outside the plane containing the swing arms.

6. A leg-actuated anterior shoulder stretching device as claimed in claim 5, wherein said leg-actuated mechanism including a foot-receiving portion, said foot-receiving portion being spaced from said plane by a dimension greater than the dimension between a user's hips and shoulders.

7. A leg-actuated anterior shoulder stretching device comprising:

a backrest having a support surface for supporting the back of a user;

a pair of swing arms linked to pivot in unison and in opposite rotational directions between a non-stretching position and a stretching position;

a leg-actuated mechanism for pivoting the swing arms in unison from the non-stretching position to the stretching position, wherein each swing arm includes an arm supporting assembly freely slidably mounted thereon for inward and outward movement along the swing arm and where each arm supporting assembly is rotationally fixed to the swing arm upon which it is slidably mounted.

8. A user-actuated anterior shoulder stretching device comprising:

a backrest having a support surface for supporting the back of a user;

a pair of laterally extending swing-arms linked to pivot in unison in a plane, each swing-arm being pivotably mounted at its proximal end and being adapted to receive a hand, wrist or forearm of a user at its distal end; and a leg-actuated mechanism for simultaneously pivoting each of the swing-arms in unison to thereby stretch the anterior shoulder of the user, said leg-actuated mechanism including a foot-receiving portion, said foot-receiving portion being spaced from said plane by a dimension greater than the dimension between a user's hips and shoulders.

9. A leg-actuated anterior shoulder stretching device comprising:

a pair of swing arms linked to pivot in unison in a plane and in opposite rotational directions between a non-stretching position and a stretching position; and a leg-actuated mechanism for pivoting the swing arms in unison from the non-stretching position to the stretching position, a backrest having a support surface for supporting the back of a user, said support surface being generally orthogonal to said plane and extending on both sides of said plane.

10. A method of self-stretching the anterior shoulder utilising a leg-actuated anterior shoulder stretching device comprising a pair of swing arms linked to pivot in unison and in opposite rotational directions between a non-stretching position and a stretching position and a leg-actuated mechanism for pivoting the swing arms in unison from the non-stretching position to the stretching position, the method comprising; locating a user's arms on the swing-arms; and actuating the leg-actuated mechanism with the users legs in order to pivot the swing arms in unison from the non-stretching position to the stretching position.

* * * * *